United States Patent [19]

Titone

[11] 4,100,770

[45] Jul. 18, 1978

[54] PROCESS AND NONRAVELING KNIT TUBULAR PRODUCTS HAVING AXIAL STRETCH

[75] Inventor: Simone Charles Titone, Birchrunville, Pa.

[73] Assignee: E. I. Du Pont de Nemours and Company, Wilmington, Del.

[21] Appl. No.: 736,459

[22] Filed: Oct. 28, 1976

[51] Int. Cl.[2] ..... D04B 23/06; D04B 23/02; D04B 23/12

[52] U.S. Cl. ..... 66/193

[58] Field of Search ..... 66/193, 192

[56] References Cited

U.S. PATENT DOCUMENTS

| | | | |
|---|---|---|---|
| 1,139,343 | 5/1915 | Clewley | 66/193 |
| 1,802,337 | 4/1931 | Decker et al. | 66/193 |
| 2,144,667 | 1/1939 | Stein | 66/192 |
| 2,603,852 | 7/1952 | Fleischer | 66/193 X |
| 2,936,603 | 5/1960 | Lewine | 66/193 |
| 3,965,703 | 6/1976 | Barnhardt | 66/193 |

FOREIGN PATENT DOCUMENTS

| | | | |
|---|---|---|---|
| 1,963,544 | 6/1971 | Fed. Rep. of Germany | 66/193 |
| 507,405 | 6/1971 | Switzerland | 66/193 |

OTHER PUBLICATIONS

Paling, Warp Knitting Technology, 1965, pp. 338–341.

*Primary Examiner*—Wm. Carter Reynolds

[57] ABSTRACT

A warp knit fabric which is stretchable in the direction of the wales by virtue of elastomer yarn forming the wales is made ravel resistant when cut in a transverse direction, by having a plurality of ends of elastomer yarn form each wale, with each yarn end having alternating knitted and laid in portions, each for a succession of stitches, the knitting and laying in of one yarn end being out of phase with the knitting and laying in of another yarn end. The wales are interconnected by inelastic yarn to form the fabric.

5 Claims, 4 Drawing Figures

PROCESS AND NONRAVELING KNIT TUBULAR PRODUCTS HAVING AXIAL STRETCH

BACKGROUND OF THE INVENTION

This invention is directed to warp knit fabric having chain stitches of elastomer yarn which are ravel resistant when cut.

U.S. Pat. No. 3,981,415 discloses the concept of a stretchable fabric having a unidirectional recovery force useful for supplying the force to dispense fluid from a container and various fabric constructions for accomplishing this utility. Among these fabric constructions are fabrics made into a tubular shape on a Raschel double needle bed knitting machine and fabrics which are in the tubular shape and which are axially stretchable. It is convenient to make axially stretchable tubular shape fabrics on the Raschel double needle bed machine in long tubular lengths which can then be cut to the shorter tubular lengths desired for the dispensing application. Since the tubular shape is axially stretchable, it is desired that the elastomer yarn providing the axial stretchability and recovery force also run in the axial direction. Unfortunately, cutting of the long tubular shape into the shorter tubular shapes involves also cutting the elastomer yarn which causes unraveling of the yarn, rendering the resultant shorter tubular shape difficult to apply to and sometimes inoperable in the dispensing application.

SUMMARY OF THE PRESENT INVENTION

The present invention provides a warp knit fabric which is stretchable in the direction of the wales of the fabric, and which is ravel resistant when cut in the direction transverse to the wales of the fabric. The fabric is made by the process comprising (a) knitting chain stitches of a plurality of ends of elastomer yarn to form the wales of said fabric, the knitting of each said wales being conducted by alternately knitting for a succession of stitches and laying in for a succession of stitches at least two of said ends of elastomer yarn, the knitting of one of said two ends being simultaneous with the lay in of the other of said two ends and the lay in of said one end being simultaneous with the knitting of said other end, and (b) interconnecting said wales with inelastic yarn to form said fabric.

The resultant warp knit fabric can be described as comprising (a) wales, each comprising a plurality of ends of elastomer yarn and consisting essentially of (i) a succession of chain stitches of one of said ends of elastomer yarn alternating with a succession of chain stitches of at least one other of said ends of said elastomer yarn, each of said chain stitches consisting essentially of only a single end of said elastomer yarn, and (ii) portions of each said one and said other ends of elastomer yarn laid into the succession of chain stitches of said other and said one ends of elastomer yarn, respectively, and (b) inelastic yarn interconnecting said wales together to form said fabric.

The ravel resistance of the wales of the fabric arises from the combination and relationship of the elastomer yarns making up each wale. More particularly, in each stitch of the wale wherein the chain stitch of one end of elastomer yarn changes to lay in and simultaneously, the lay in of another end of elastomer yarn changes to chain stitch, any unraveling due to cutting of the wale stops. This phenomonon will be described in further detail hereinafter.

BRIEF DESCRIPTION OF THE DRAWINGS

FIG. 1 shows a composite of knitting motions of different yarns to make the specific embodiment of fabric described in the specific example later herein. In FIG. 1, the courses are alternately identified as F and B standing for front and back needles, respectively, of the knitting machine.

Yarns 2 and 4 are elastomer yarns shown as knitting only on the front needles of the knitting machine. This pair of elastomer yarns forms one wale of the fabric of the present invention. Specifically, elastomer yarn 2 is knitted for a succession of stitches and is then laid in for a succession of stitches. Elastomer yarn 4 is laid into the stitches of yarn 2 and then knitted for a succession of stitches, with yarn 2 being laid into these stitches. In other words, the knitting and laying in of yarns 2 and 4 is out of phase with respect to each other. The expression "laying in" or "laid in" or variations thereof is used herein in describing the elastomer yarns in the broad sense of including both the situation where the elastomer yarn is held within the stitches of the other elastomer yarn and also the situation where the elastomer yarn floats along the outside of the stitches of the other elastomer yarn.

Interconnecting the wales of the fabric is inelastic yarn 6 laid into each stitch of each wale.

Figure 2:
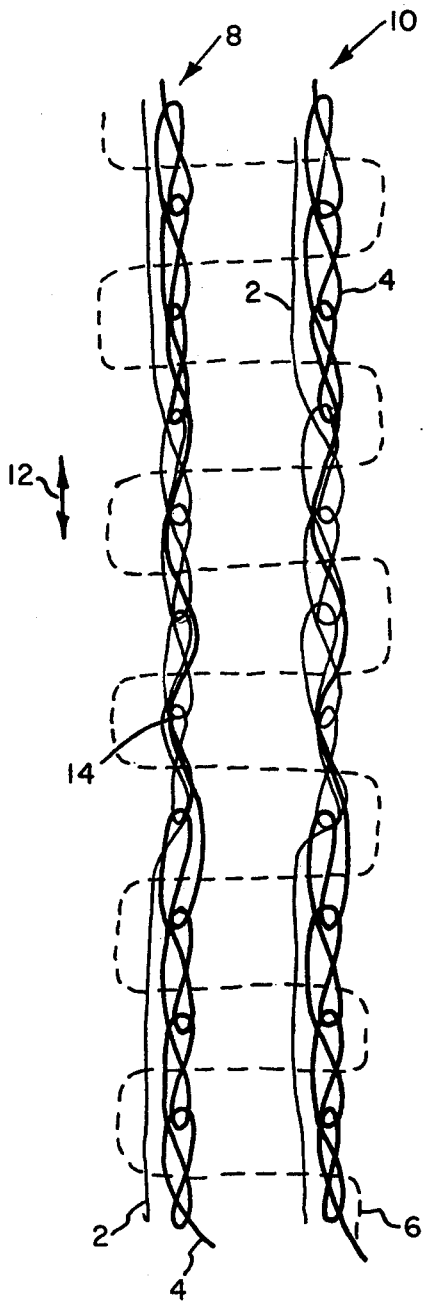
FIG. 2 shows in schematic plan view a portion of an embodiment knitted essentially according to the knitting motions of FIG. 1.

The relationship between the elastomer yarns 2 and 4 and interconnection by yarn 6 is better seen from the adjacent pair of wales 8 and 10 shown in FIG. 2. This relationship is shown as though the fabric were knitted on every needle of a single needle bed knitting machine, which indeed is possible. As shown in FIG. 2, each wale comprises chain stitches of the alternating successions of stitches of elastomer yarns 2 and 4 and alternating successions of laid-in portions of these same yarns. Since the succession of stitches of each elastomer yarn is alternating, then each stitch of each wale is made of only one of the ends of elastomer yarns 2 and 4. As seen from FIG. 2, elastomer yarn 2 floats along the wales 8 and 10 while yarn 4 is knitting, and yarn 4 is actually trapped in the stitches while yarn 2 is knitting. Inelastic yarn 6 interconnects these adjacent wales together. Different ends of inelastic yarn interconnect wales 8 and 10 with their other respective adjacent wales (not shown) and so on to form the fabric.

The fabric is stretchable in the direction of the wales which is shown by arrow 12 in FIG. 2. The interconnection of the wales by the lay in pattern shown for inelastic yarn 6 does not prevent such stretching but does prevent any substantial stretch in the direction transverse to the wales.

Figure 3:
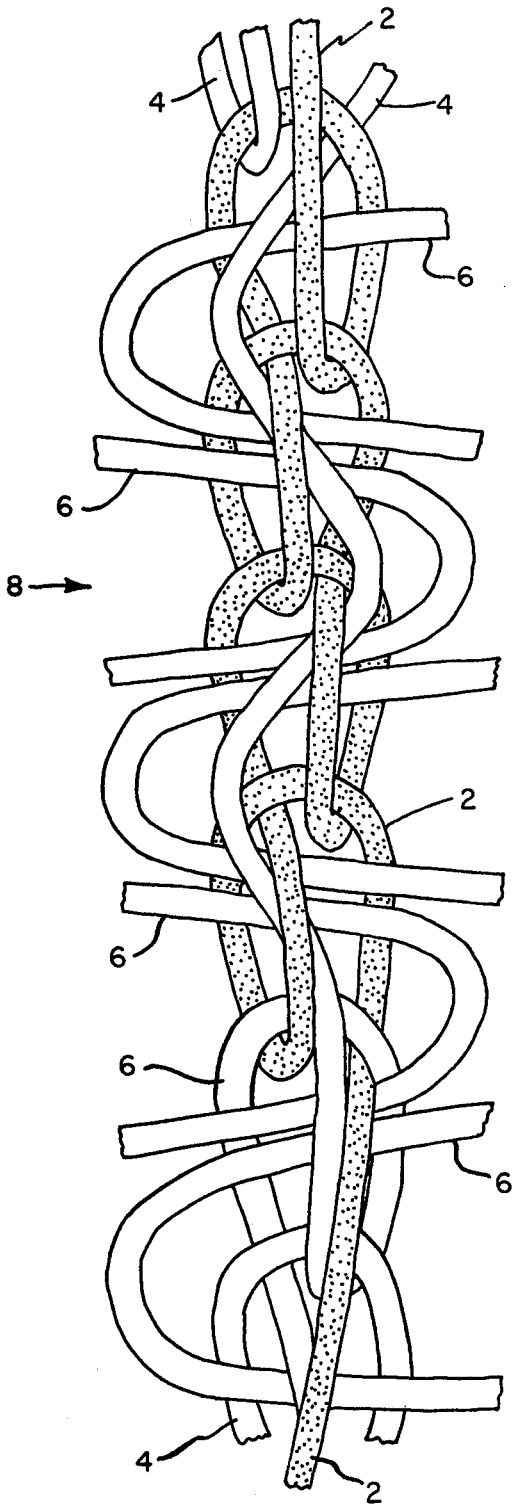
FIG. 3 shows a drawing in enlargement of a portion of a wale line of the fabric made according to FIG. 1.

FIG. 3 shows in even greater detail one region of wale 8 where yarn 4 changes from knitting to lay in and simultaneously, yarn 2 (stippled) changes from lay-in (float) to knitting. Two ends of inelastic yarn 6 interconnecting wale 8 with its adjacent wales are also shown. Ravel resistance is provided by this relationship as will be explained hereinafter.

If the wale 8 is cut at course 14 (FIG. 2), the stitch of yarn 2 unravels in the direction opposite to the knitting direction but only until reaching the succession of stitches of the other elastomer yarn, i.e., yarn 4. There the unraveling stops because there the knitting of elastomer yarn 2 into stitches also stops. The cutting of the laid in yarn 4 with the cutting of the stitch of yarn 2 does not cause the stitches of yarn 4 to unravel. The retained integrity of the succession of chain stitches just preceding the location of cutting of the wale is the stopping point of unraveling, thereby providing ravel resistance to the fabric. The tendency of unraveling in the knitting direction is less than in the opposite direction. Even this tendency is lessened by the succession of chain stitches just succeeding the location of cutting of the wale. The cutting of the wale is into a succession of stitches of one of the elastomer yarns; it is the preceding and succeeding succession of stitches of the other elastomer yarn, yarn 4 in FIG. 2, that provide the stopping points for the unraveling in both directions along the wale due to the cutting of the wale.

Generally, the ravel resistance of the wales and thus of the fabric in the walewise direction increases as the number of stitches in the succession of stitches increases. At least two stitches in the succession is required. On the other hand, the succession of stitches should not be too long because this increases the extent of unraveling until the preceding or succeeding succession of stitches stops the unraveling. Thus, a succession of stitches of knitting generally need not be greater than 8 stitches. Preferably the succession of knit stitches will be from 3 to 5 stitches long. The number of stitches of knitting and of lay in will generally be the same.

Figure 1:
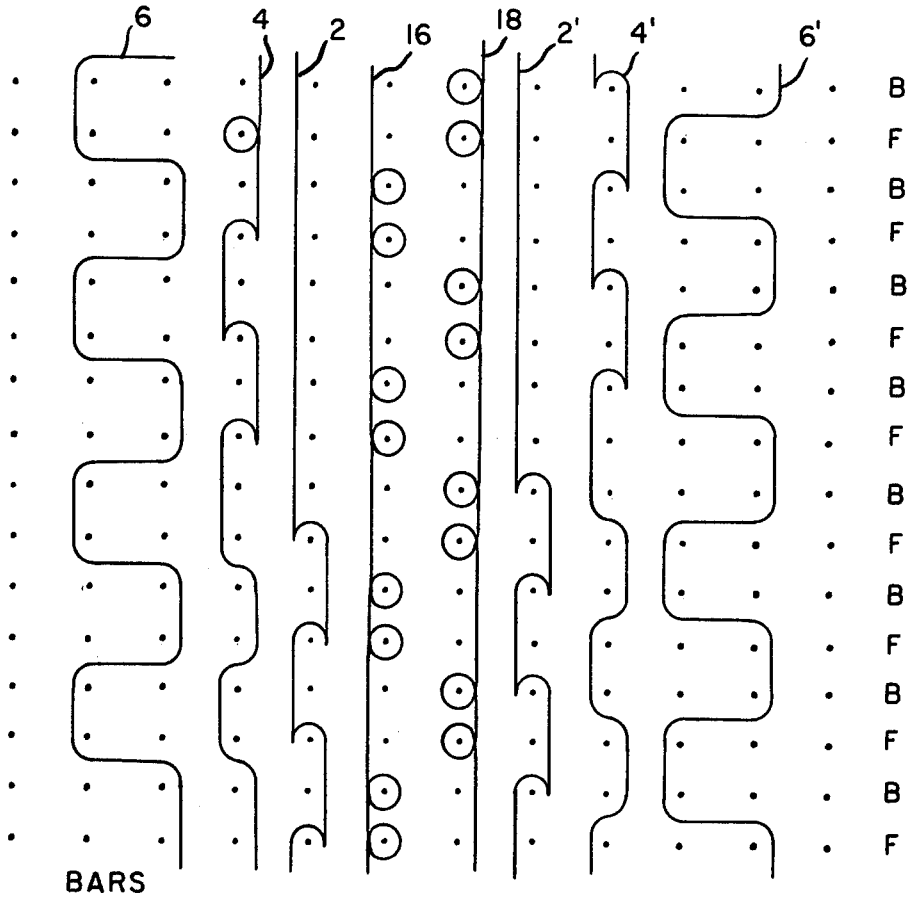
FIG. 1 shows a point diagram of the knitting motions for a double needle bed Raschel knitting machine producing one embodiment of fabric of the present invention in the form of a tubular shape.

In another embodiment of the present invention, the fabric is knitted directly as a flat tubular shape on a Raschel double needle bed knitting machine. The remaining yarns and knitting motions shown in FIG. 1 provide this result. More specifically, yarns 2' and 4' are knitted into a single wale on the back face (panel) of the tubular shape, in the same relationship as the wale of yarns 2 and 4 on the front face of the tubular shape. The knitting machine alternates from course to course between knitting on the front needle bed and the back needle bed. To this extent, the faces of the flat tubular shape are knitted simultaneously. It will be noted from FIG. 1 that yarns 2' and 4' only knit on the back needle bed. Similarly, inelastic yarn 6' interconnects the adjacent wales of the back face (panel) of the tubular shape.

Simultaneous with the knitting of the front and back faces, selvedge is also knitted to interconnect these faces along their lengthwise edges to form the tubular shape. This is provided by elastomer yarns 16 and 18 which are alternately knit and laid-out of phase with respect to each other in the same manner as the formation of wale 8. The yarns 16 and 18 are also of elastomer yarn so as to permit the walewise stretching of the tubular shape.

The fabric of the present invention either as a flat fabric or as a tubular shape can be knitted continuously in long lengths which can be cut into shorter lengths in the direction transverse to the direction of the wales of the fabric, i.e., fabric length, without any appreciable amount of unraveling. This is contrary to the usual experience with chain stitches, which when cut, tend to unravel along their entire (wale) length. In the tubular shape of fabric of the present invention, the wales (chain stitches) extend axially along the tubular shape to give it axial or lengthwise stretchability, while the inelastic yarn extends circumferentially, interconnecting the wales together.

Figure 4:
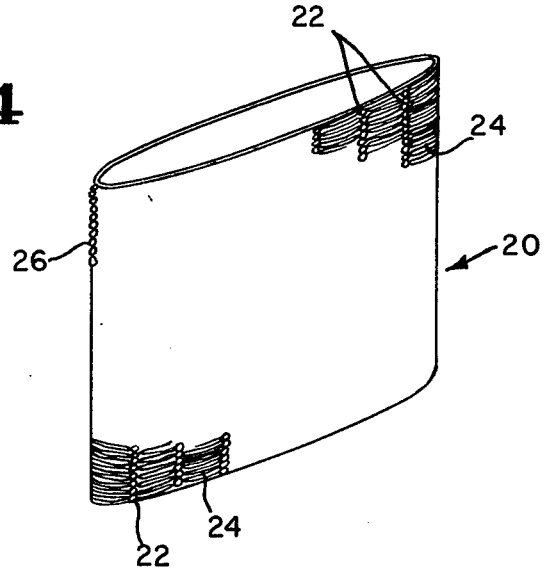
FIG. 4 shows a schematic perspective view of one embodiment of tubular shape of the present invention.

FIG. 4 shows fabric of the present invention in the form of a tubular shape 20 knitted on a Raschel double needle bed machine. The wales of chain stitches of elastomer yarn are indicated as 22 and each can be the same as wale 8. previously described herein. The inelastic yarn interconnecting the wales 22 is indicated as 24 and can be the same as inelastic yarn 6 previously described herein. The selvedge is indicated at 26 (only one shown) and can be the same as formed by yarns 16 and 18 previously described herein.

The elastomer yarn is preferably bare and has an elongation at break of at least 300% and recovery force at 100% elongation of at least 0.01 g per denier and preferably at least 0.02 g per denier, measured as described in the aforesaid patent. This yarn can be made of such materials as natural or synthetic rubber of segmented polyurethane, also known as spandex. The total denier of the elastomer yarn in each wale is high, generally at least 8,000 denier and preferably at least 12,000 denier. The elastomer yarn can be single, plied, or coalesced multifilament or monofilament yarn.

The inelastic yarn can be any conventional inelastic yarn which has little or no stretchability, preferably an elongation at break of less than 50%. The preferred inelastic yarn is a flat yarn, i.e., nontextured, or if textured, then the texturing is such that the yarn is substantially inextensible, e.g., Taslan® yarns. When laid in as shown for yarns 6 and 6' almost perpendicular to the wales of the fabric, the resultant fabric has virtually no stretch in width direction, which is the circumferential direction of tubing knitted of the fabric. The inelastic yarn can be made of such materials as cotton, nylon, acrylic, rayon, or polyester and can be continuous filament or staple fiber.

The chain stitch forming the wales of the fabric can be an open stitch or a closed stitch or any combination thereof. More than two ends of elastomer yarn can be present in each wale of the fabric. Each additional end of such yarn can either be laid in entirely or alternately knit in and laid in, each for a succession of stitches out of phase with both of the other two ends of elastomer yarn to retain the relationship that each stitch forming the wale is of only one end of elastomer yarn. The interconnection of the wales by inelastic yarn is preferably an interconnection between adjacent wales only and this preferably by lay in of the inelastic yarn into each stitch. This minimizes any necking down of the fabric (or tubular shape) when stretched in the direction of the wales.

The elastomer yarn is the main component of the fabric, constituting from 65 to 98%, preferably 75 to 95% of its weight. The inelastic yarn is present in a relatively minor proportion to perform the function of interconnecting the chain stitches (wales) of elastomer yarn and to maintain the fabric position thereof to prevent blowout of the volume expansible member being filled with fluid as described in the aforesaid patent.

The fabric (and tubular shape) has an elongation of at least 200% and more preferably at least 275% in the lengthwise direction and a recovery force of at least 750 g per cm of fabric width and preferably at least 1,000 g per cm measured as described in the aforesaid patent. To achieve this recovery force, the elastomer yarn will generally amount to at least 20,000 denier per cm of fabric width and preferably at least 50,000 denier per cm of fabric width.

An example of fabric of the present invention is as follows: A series (side by side) of tubular shape fabrics were knitted on a 36-gauge, double needle bed Raschel knitting machine (18 gauge for needles and guides) using spandex yarn to form the wales and nylon yarn to interconnect the wales as shown in FIG. 1. Eight guide bars were used to make this fabric. Bars 2–7 were threaded with 2240-denier spandex yarn. Bars 1 and 8 were threaded with 3-ply, 210-denier nylon. The fabric was knit on a 30-needle set out (8.47 cm per band). Guides 1-29 of Bars 1 and 8 were fully threaded. Guides 2-29 of Bar 2 were fully threaded. Guides 3-30 of Bars 3, 6, and 7, respectively, were fully threaded. Guides 2 and 31 of Bar 4 were threaded. Guides 1 and 30 of Bar 5 were threaded. The chain readings for producing the bar movement patterns for the tubular fabric were as follows, the warp-knitters' Raschel notation for double needle bed machine being used:

Bar 1 0-0/0-0/8-8/8-8 and repeat

Bar 2
0-0/0-0/4-4/4-4/0-0/0-0/4-4/4-4/4-0/0-0/0-4/4-4-/4-0/0-0/0-4/0-0

Bar 3
4-0/0-0/0-4/4-4/4-0/0-0/0-4/4-4/4-4/4-4/4-4/4-4-/4-4/4-4/4-4/4-4

Bar 4 4-0/4-0/4-0/0-4 and repeat

Bar 5 0-0/0-0/0-4/0-4 and repeat

Bar 6
4-4/4-0/0-0/0-4/4-4/4-0/0-0/0-4/4-4/4-4/4-4/4-4-/4-4/4-4/4-4/4-4

Bar 7
4-4/0-0/0-0/4-4/4-4/0-0/0-0/4-4/4-4/4-0/0-0/0-4-/4-4/4-0/0-0/0-4

Bar 8 0-0/8-8/8-8/0-0 and repeat.

The resultant long lengths of tubular shape fabric could be cut into shorter lengths without any appreciable unraveling. The fabric was 7 cm in relaxed width, consisted of about 70 weight percent of elastomer yarn, had an elastomer yarn concentration of greater than 20,000 denier per cm of fabric width, and a recovery force of greater than 750 g per cm of fabric width and axial elongation of at least 200 percent.

Since many different embodiments of the invention can be made without departing from the spirit and scope thereof, it is to be understood that the invention is not to be limited except to the extent defined in the following claims.

What is claimed is:

1. A process for warp knitting a fabric which is stretchable in the wale direction and is ravel resistant when cut in the transverse direction, comprising a. knitting chain stitches of a plurality of ends of elastomer yarn to form the wales of said fabric having at least 20,000 denier of said elastomer yarn per cm of fabric width, the knitting of each said wales being conducted by alternately knitting for a succession of at least 4 stitches and laying in for a succession of at least 4 stitches at least two of said ends of elastomer yarn, the knitting of one of said two ends being simultaneous with the lay in of the other of said two ends and the lay in of said one end being simultaneous with the knitting of said other end, and b. interconnecting said wales with inelastic yarn to form said fabric.

2. A ravel resistant warp knit fabric comprising a. wales, each comprising a plurality of ends of elastomer yarn and consisting essentially of (i) a succession of at least 4 chain stitches of one of said ends of elastomer yarn alternating with a succession of at least 4 chain stitches of at least one other of said ends of said elastomer yarn, each of said chain stitches consisting essentially of only a single end of said elastomer yarn, and (ii) portions of each said one and said other ends of elastomer yarn laid into the succession of chain stitches of said other and said one ends of elastomer yarn, respectively, and b. inelastic yarn interconnecting said wales together to form said fabric, said fabric having at least 20,000 denier of said elastomer yarn per cm of fabric width.

3. The warp knit fabric of claim 2 wherein said inelastic yarn interconnects adjacent wales of said fabric.

4. The warp knit fabric of claim 3 wherein said inelastic yarn is laid in coursewise into each stitch of said wales.

5. The fabric of claim 2 in the form of a tubular shape wherein the wales of the fabric run in the axial direction of said tubular shape.

* * * * *